US007207815B1

(12) United States Patent
Ju

(10) Patent No.: US 7,207,815 B1
(45) Date of Patent: Apr. 24, 2007

(54) CARD CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/402,046

(22) Filed: Apr. 12, 2006

(51) Int. Cl.
*H01R 13/62* (2006.01)

(52) U.S. Cl. ..... 439/159; 439/607; 439/630

(58) Field of Classification Search ..... 439/630, 439/607–608, 633–634, 159–160, 941
See application file for complete search history.

(56) References Cited

U.S. PATENT DOCUMENTS 5,006,080 A * 4/1991 Ichitsubo et al. ..... 439/634
5,030,140 A * 7/1991 Sugiyama ..... 439/607
5,429,523 A * 7/1995 Tondreault ..... 439/157
5,820,390 A * 10/1998 Takamoto et al. ..... 439/78
5,980,282 A * 11/1999 Cheng ..... 439/157
6,428,360 B2 * 8/2002 Hassanzadeh et al. ..... 439/633
6,695,630 B1 * 2/2004 Ku ..... 439/152
6,709,286 B1 * 3/2004 Korsunsky et al. ..... 439/557
6,726,492 B1 * 4/2004 Yu ..... 439/108

* cited by examiner

*Primary Examiner*—Michael C. Zarroli
(74) *Attorney, Agent, or Firm*—Troxell Law Office PLLC

(57) ABSTRACT

A card connector for connecting an expansion card to a circuit board and including a long insulating body with a central slot and a plurality of conductive terminals. The card connector also includes a metal casing with a covering function covering the insulating body. The metal casing prevents electromagnetic interference.

9 Claims, 4 Drawing Sheets

CARD CONNECTOR

BACKGROUND OF THE INVENTION (a) Field of the Invention

The present invention relates to connectors, and in particular to a card connector.

(b) Description of the Prior Art

In the connector industry, a card connector serves to connect an expansion card and a circuit board and usually includes a plastic seat and an ear buckle. The plastic seat has a plurality of conductive terminals and two sides have tower-shape portions. A receiving space is formed in a middle of the tower-shape portions so as to receive the ear buckle. Pivotal holes are formed at an interior of two side walls of the receiving space. The ear buckle is pivotally located in the pivotal hole. The ear buckle is capable of fixing firmly an expansion card to a card connector preventing signal interruption because of shaking of the expansion card. A retract mechanism is installed at the ear buckle so as to eject the expansion card from the card connector by rotating the ear buckle. However, accompanying with developing electric devices, electromagnetic interference caused by operating electric devices becomes more and more serious. Obviously, electromagnetic interference will seriously influence operation of the prior art of the card connector.

Therefore, it is necessary to develop a novel card connector for overcoming the above defects.

SUMMARY OF THE INVENTION

The primary objection of the present invention is to provide a card connector to assure a normal operation of the card connector. In order to achieve the object, the card connector connects an expansion card to a circuit board and has a long insulating body with a central slot and a plurality of conductive terminals. The card connector also has a metal casing with a covering function so as to cover the insulating body.

Compared to the prior arts, the card connector is capable of preventing electromagnetic interference so as to achieve a normal operation.

DETAILED DESCRIPTION OF THE PREFERRED EMBODIMENTS

In order that those skilled in the art can further understand the present invention, a description is provided below. However, these descriptions and the appended drawings are only used to cause those skilled in the art to understand the objects, features, and characteristics of the present invention, but not to be used to confine the scope and spirit of the present invention defined in the appended claims.

Figure 1:
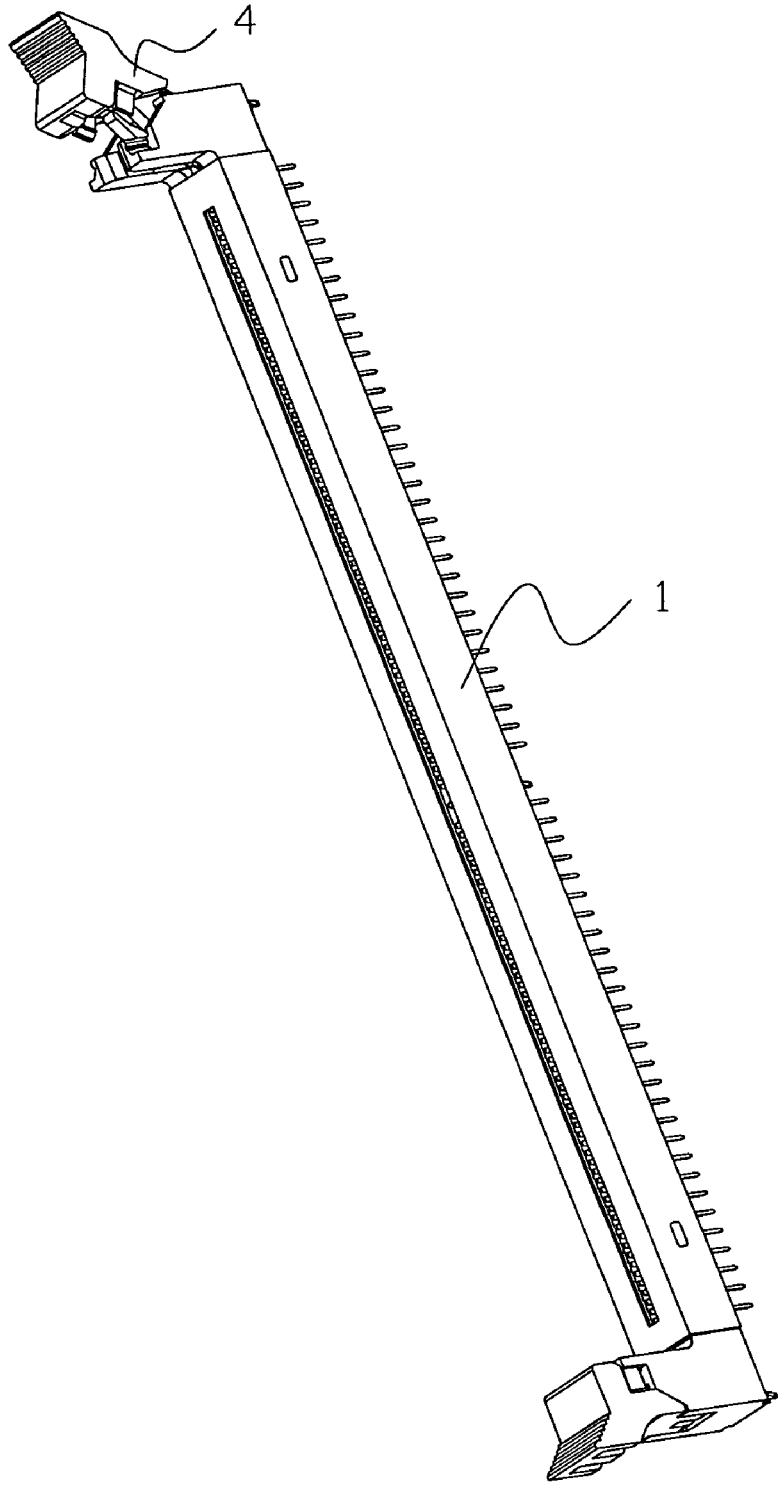
FIG. 1 is an assembled perspective view of the present invention.
Figure 2:
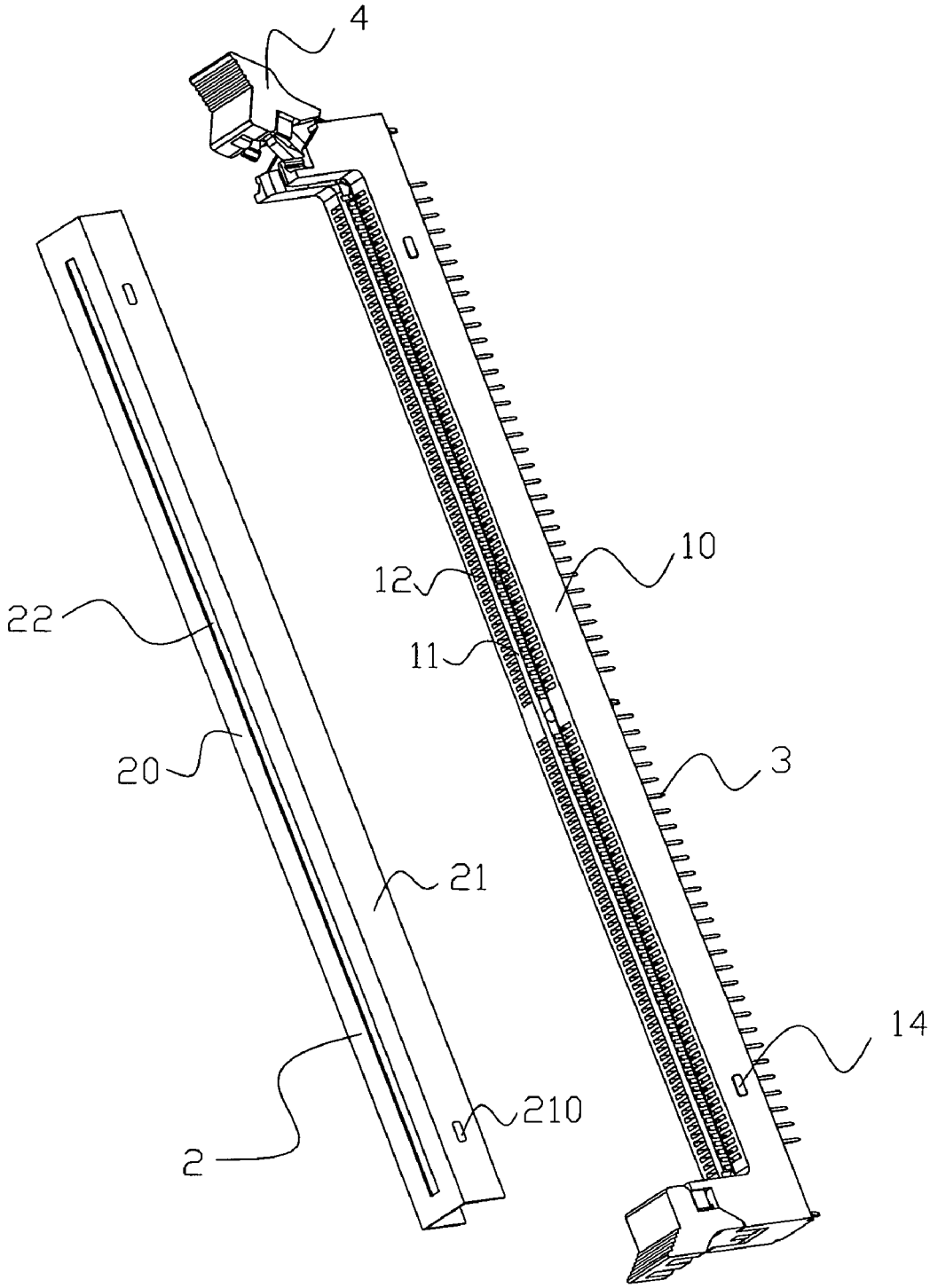
FIG. 2 is an exploded perspective view of the present invention.
Figure 3:
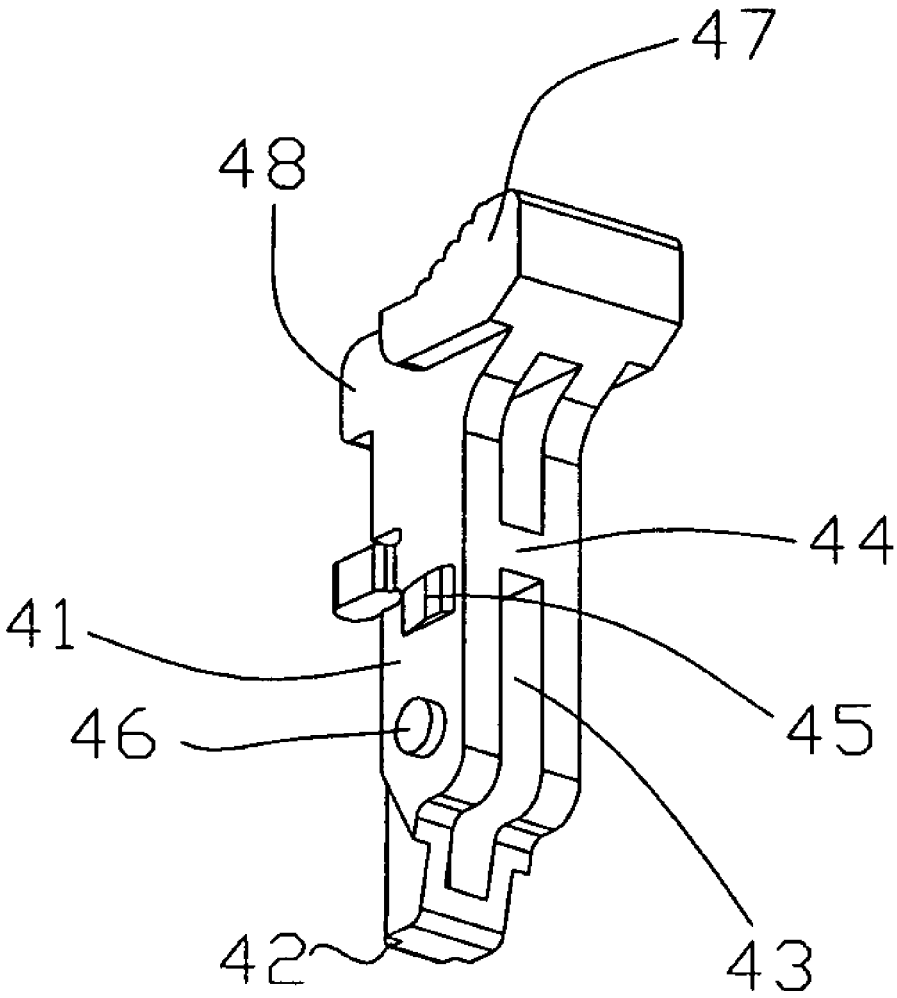
FIG. 3 is an illustration of the ejection device of the card connector of the present invention.
Figure 4:
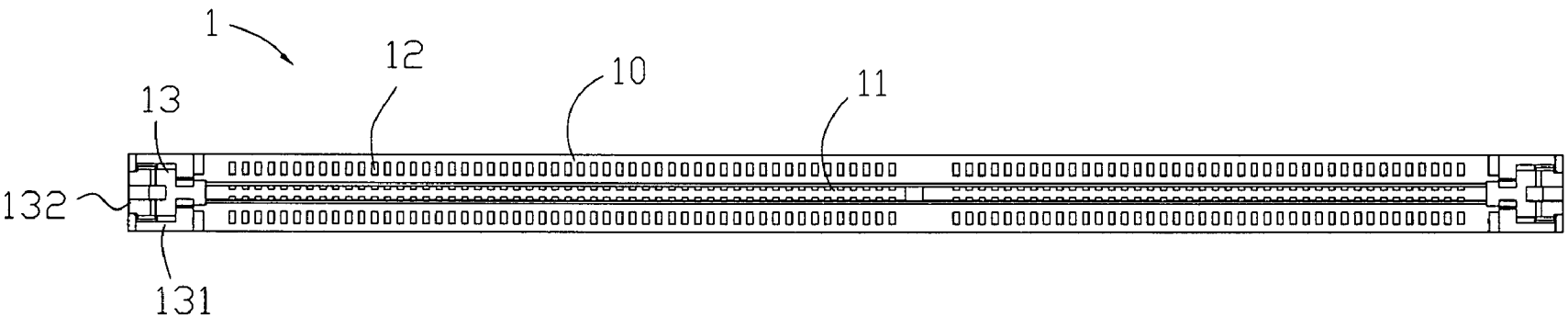
FIG. 4 is an illustration of the insulating body of the card connector of the present invention.

FIGS. 1 to 4 illustrate the card connector of the present invention. The card connector of the present invention is used to connect an expansion card (not shown) to a circuit board (not shown). The card connector includes a long insulating body 1, a metal casing 2 covering he long insulating body 1, a plurality of conductive terminals 3 and two ejection devices 4.

The long insulating body 1 includes a pair of longer walls 10. The walls 10 are located along the axial direction and have a central slot 11. Two sides of the central slot 11 have two lines of terminal receiving holes 12 passing through the central slot 11. The conductive terminals 3 are received in the terminal receiving holes 12. The two ends of the long insulating body 1 have receiving portions 13 so as to receive the ejection devices 4. The receiving portion 13 is formed by two shorter lateral walls 131 and an end wall 132. A pivotal hole (not shown) is formed closely on the end wall 132 of an inner side of the receiving portion 13.

The metal casing 2 is shaped into a sheet metal by pressing. The metal casing 2 includes a main body 20 and an extending retainer 21 formed by bending downwards two sides of the main body 20. The main body 20 has a through hole 22 corresponding to the central slot 11. Outwardly protruding protrusions 14 are installed on the insulating body 1. The retainer 21 has a retainer groove 210 corresponding to each protrusion 14 so as to fix the metal casing 2 to the long insulating body. Alternatively, the long insulating body 1 has a downwards recess. Correspondingly, the receiving portion 13 has a matching fixing block so as to achieve the same purpose of fixing the metal casing 2 to the long insulating body 1.

The ejection device 4 is pivotally connected to the receiving portion 13. The ejection device 4 comprises a main body 41 and an ejection portion 42 formed by extending ends of the main body 41 so as to eject out a corresponding expansion card. The main body 41 has a long groove 43 passing through the main body 41. The middle of the long groove 43 has a connecting arm 44. Two sides of the main body 41 have projections 45 located close to the connecting arm 44. When the ejection device 4 is received in the receiving portion 13 and rotated to a closed situation, the projection 45 buckles with an interior of the stop wall. A rotary shaft 46 is placed suitably under the projection 45 of the main body 41 so as to match up the pivotal hole on an inner side of the receiving portion 13. The main body 41 has an operation portion 47 located on an end opposite the ejection portion 42 and the operation portion 47 inclines outwardly. The opposite end of the operation portion 47 extends inwards to form a projection portion 48. The projection portion 48 is capable of buckling with the recess on the two sides of the expansion card so as to firmly fix the expansion card to the card connector, thereby achieving an electrical connection between the expansion card and a circuit board. Due to the metal casing 2, the electric connection avoids electromagnetic interference.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A card connector for connecting an expansion card to a circuit board comprising:

a) an insulating body having:

i) two walls extending along a length thereof and having a plurality of terminal receiving holes;

ii) a central slot formed between the two walls; and iii) at least one protrusion;

b) a plurality of conductive terminals inserted into the plurality of terminal receiving holes and selectively connected to the expansion card and the circuit board; and c) a metal casing connected to the insulating body and having:

i) a through hole aligning with the central slot of the insulating body; and ii) at least one retainer groove spaced apart from edges thereof, the at least one protrusion of the insulating body is inserted into the at least one retainer groove, wherein the metal casing has bottom edges located flush with a bottom of the insulating body.

2. The card connector according to claim 1, wherein the metal casing includes a main body and an extending retainer, the extending retainer includes a portion extending downwardly from each of two opposing sides of the main body.

3. The card connector according to claim 1, further comprising at least one ejection device, the insulating body having at least one receiving portion located on an end thereof, the at least one ejection device is pivotally connected to the at least one receiving portion.

4. The card connector according to claim 3, wherein the at least one receiving portion having two lateral walls and an end wall, the at least one ejection device having a rotary shaft pivotally connected to the end wall of the at least one receiving portion.

5. The card connector according to claim 3, wherein the at least one ejection device having:

a) a groove extending between a first end and a second end; and b) a connecting arm located between the first end and the second end and extending across the groove.

6. The card connector according to claim 3, wherein the at least one ejection device having:

a) an operation portion located on a first end thereof; and b) an ejection portion located on a second end thereof.

7. The card connector according to claim 3, wherein the at least one ejection device has two ejection projections extending outwardly from opposing sides thereof and selectively engaging the at least one receiving portion.

8. The card connector according to claim 3, wherein the at least one ejection device having:

a) a projection portion located on a first end, the projection portion selectively inserted into a recess in the expansion card; and b) an ejection portion located on a second end thereof.

9. The card connector according to claim 1, wherein the metal casing is a metal sheet.

* * * * *